United States Patent [19]

Rockx

[11] Patent Number: 4,760,815

[45] Date of Patent: Aug. 2, 1988

[54] APPARATUS FOR DISPLACING AIR THROUGH A CABINET FOR SPRAYING PAINT

[75] Inventor: Ludwig G. Rockx, Rietven, Netherlands

[73] Assignee: NIRO Atomizer B.V., Apeldoorn, Netherlands

[21] Appl. No.: 32,525

[22] Filed: Apr. 1, 1987

[30] Foreign Application Priority Data

Apr. 1, 1986 [NL] Netherlands ..... 8600818

[51] Int. Cl.[4] ..... B05B 15/12

[52] U.S. Cl. ..... 118/326; 98/115.2; 118/DIG. 7

[58] Field of Search ..... 98/115.2, 115.3; 118/326, DIG. 7

[56] References Cited

U.S. PATENT DOCUMENTS

| | | | |
|---|---|---|---|
| 3,168,030 | 2/1965 | Wilhelmsson et al. | 98/115.2 |
| 3,395,972 | 8/1968 | Hardison | 118/326 X |
| 3,745,908 | 7/1973 | Mayberry | 98/115.3 |
| 3,807,291 | 4/1974 | Roberts et al. | 98/115.2 |
| 3,897,229 | 7/1975 | Lada | 98/115.3 X |

FOREIGN PATENT DOCUMENTS

| | | | |
|---|---|---|---|
| 1591888 | 7/1981 | United Kingdom | 98/115.3 |

*Primary Examiner*—Shrive P. Beck

*Attorney, Agent, or Firm*—Oblon, Fisher, Spivak, McClelland, Maier

[57] ABSTRACT

Apparatus for displacing air through a cabinet for spraying paint. In the preferred embodiment, first and second fans are mounted in a case, and first and second valves are pivotally mounted within the case. In a first position of the valves, the first fan draws fresh air from outside the case and discharges it into the cabinet while the second fan draws air from the cabinet and discharges it from the case to the outside via an exhaust. The valves may be moved to a second position to cause the simultaneous closing of the discharge of the first fan, interruption of a portion of the second fan discharge that is directed to the exhaust, and opening of the discharge of the second fan into the interior of the cabinet, thereby providing for recirculation of cabinet air.

8 Claims, 1 Drawing Sheet

APPARATUS FOR DISPLACING AIR THROUGH A CABINET FOR SPRAYING PAINT

BACKGROUND OF THE INVENTION

1. Field of the Invention

The invention relates to an apparatus for displacing air through a cabinet for spraying paint, comprising two fans, whereby by means of a first fan air from the outside can be sucked and can be supplied into the interior of the cabinet, whilst at the same time by means of a second fan air can be sucked from the cabinet for spraying paint and can be discharged to the outside via an exhaust.

2. Discussion of the Background

In a known apparatus of the kind set forth there has been provided, in the suction duct of the first fan, a valve by means of which the connection between the fan and the suction duct which is in communication with the outside air can be closed, whilst at the same time there can be formed a communication between the first fan and a discharge duct which is in open communication with the interior of the cabinet.

When spraying is finished and the object, which has been painted, has to be dried, then the position of said valve is changed so that by means of the first fan air is sucked from the cabinet and re-supplied into the cabinet. At the same time the second fan is put out of work.

Said known device is relatively cumbersome and has the further disadvantage, that after the second fan is put out of work the second fan still runs for some time so that said second fan will also suck air out of the cabinet, whereby there can occur a vacuum in the cabinet so that, if there are slits in the walls of the cabinet, there could be sucked air, contaminated with dust into the cabinet.

SUMMARY OF THE INVENTION

Now according the invention there have been provided means by which the discharge side of the first fan can be closed and at the same time the communication between the discharge side of the second fan and the exhaust can be interrupted and further there will be made a communication between the discharge side of the second fan and the interior of the cabinet for spraying paint.

In using the structure according the invention there can be obtained a simple compact apparatus which also prevents the occurence of vacuum in the spraying cabinet during changing over from supplying fresh air and discharging contaminated air during spraying to re-circulating air during drying.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
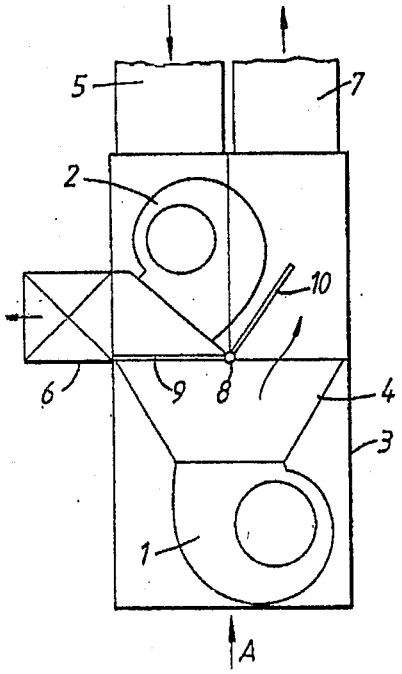
FIG. 1 shows an embodiment of an apparatus according the invention in a first working position.
Figure 2:
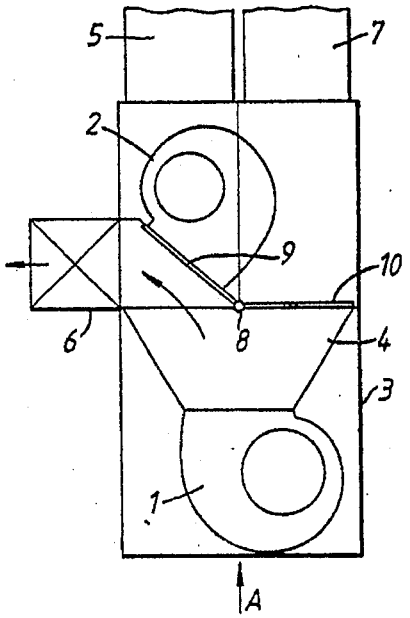
FIG. 2 shows the apparatus shown in FIG. 1 in a second working position.

The apparatus shown in FIGS. 1 and 2 comprises two centrifugal fans 1 and 2, preferably having the same capacities. Said fans 1 and 2 have been arranged one above the other in a case 3, whereby both fans have been staggered with respect to each other in a sideward direction.

The suction side of the fan 1 has been connected with an air discharge channel arranged below the floorgrids of a cabinet for spraying paint. Air can be sucked by the fan 1 in the direction as indicated by arrow A.

The discharge spout of the fan 1 increases in area in a trumpet like way and has a width substantially equal to the width of the case 3.

The suction side of the fan 2 is in open communication with a suction duct 5 connected to the case 3, whereby fresh open air can be sucked via said duct 5.

The discharge side of the fan 2 is in communication with a filter compartment usually arranged near the upper side of the spraying cabinet whereby air can be supplied into the interrior of the spraying cabine via said filter compartment.

If desired, there could be arranged an air heating device 6 on the discharge side of the fan 2.

Separated from the supply duct 5, there has also been joined to the case 3 an air discharge duct 7.

Further, the apparatus comprises a valve mechanism having two valves 9 and 10 which are together rotatable about a pivot axis 8 extending perpendicularly to the plane of the drawing. As appears from the figures the valves 9 and 10 are arranged so, that said valves make an angle which each other.

In the position shown in FIG. 1, valve 9 closes the left hand portion of the discharge spout 4, whilst the valve 10 exposes the right hand portion of the discharge spout 4 of the fan 1, so that the discharge side of the fan 1 is in open communication with the air discharged duct 7.

In said position the apparatus is used during spraying of paint in the spraying cabinet.

Thereby fresh air will be sucked via the duct 5 by means of the fan 2 and blown into the interrior of the filter compartment, after pre-heating if desired. At the same time air will be sucked from the spraying cabinet by means of the fan 1 and discharged via the duct 7.

From the position of FIG. 2, the valve mechanism 9, 10 can be pivoted into the position shown in FIG. 2.

In said position the discharge side of the fan 2 has been closed by means of the valve 9. Further the right hand portion of the discharge spout 4 of the fan 1 has been closed, so that the connection between the discharge side of the fan 1 and the discharge duct 7 has been interrupted. Instead, there has been formed an open communication between the discharge side of the fan 1 and the duct for supplying air into the interior of the paint spraying cabine. In said position of the valve mechanism, which is used for circulating air through the spraying cabinet during the periods that paint is not being sprayed (e.g. during drying of a product which has been painted), the fan 2 will be put out of work and by means of the fan 1 there will be sucked air out of the cabinet and supplied again into the cabine.

In a structure according the invention, both fans, the corresponding valve mechanism and the like can be accomodated in a simple way in a case 3 having a compact structure. Such a case can be completely pre-fabricated and thereafter said case can be arranged in a simple way in or near a spraying cabine, whereby such a case will require only a little space.

Further, the transport of such an apparatus can be done in an advantageous and safe way by the compact structure. Also there can be obtained substantial savings in cost.

A further advantage is also, that the required system of ducts for circulating air in the paint spraying cabine also can be made in a compact way.

It will be clear, that both valves 9 and 10 can be made, if desired, as a single unit.

Preferably the effective amount of air produced by both fans is the same. However, fan 2 may be a little smaller than fan 1, in view of the fact that the first cited fan 2 meets less resistance than does the fan 1. Thereby the width of the space taken up by the fan 2 could be smaller than the width of the space taken up by the fan 1, whereby there is obtained space not only for fan 2 but also for the operating mechanism of the valves 9 and 10.

Obviously, numerous modifications and variations of the present invention are possible in light of the above teachings. It is therefore to be understood that within the scope of the appended claims, the invention may be practiced otherwise than as specifically described herein.

I claim:

1. Apparatus for displacing air through a cabinet for spraying paint and cooperable with a fresh air supply and an air exhaust, comprising:

first and second fans; and air flow directing means, such air flow directing means, in a first configuration thereof, comprising means for causing fresh air to be drawn from the fresh air supply by said first fan and discharged therefrom into the interior of the cabinet, and for causing air to be drawn from the cabinet by said second fan and discharged therefrom to the air exhaust, said air flow directing means being changeable to a second configuration thereof and, in achieving said second configuration, comprising means for substantially simultaneously:

closing the discharge of said first fan, interrupting the discharge of said second fan into the air exhaust, and communicating the discharge of said second fan into the interior of the cabinet.

2. Apparatus according to claim 1, said air flow directing means comprising first and second valves cooperable with a discharge mouth of said second fan, said first valve comprising means for selectively opening and closing a portion of said discharge mouth of said second fan that communicates with the air exhaust, said second valve comprising means for selectively opening and closing a portion of said discharge mouth of said second fan that communicates with the interior of the cabinet.

3. Apparatus according to claim 2, said second valve being adjustable between a first position, in which said second valve closes communication between the discharge of said second fan and the interior of the cabinet, and a second position, in which said second valve both opens communication between the discharge of said second fan and the interior of the cabinet and closes the discharge of said first fan.

4. Apparatus according to one of claims 2 or 3, wherein said first and second valves are mounted for simultaneous rotation about a commom pivot axis.

5. Apparatus according to claim 1, wherein said first and second fans are mounted in a case, the discharges of said first and second fans being directed towards each other.

6. Apparatus according to claim 5, wherein said first and second fans are transversely staggered with respect to a longitudinal direction of said case.

7. Apparatus according to one of claims 1, 5 or 6, wherein said second fan is disposed with its discharge directed substantially straight upward and said first fan is disposed with its discharge inclined in a sidewards direction.

8. Apparatus according to claim 1, said first and second fans being mounted in a case, said apparatus further comprising:

a cabinet discharge duct for carrying air from the interior of said cabinet, said cabinet discharge duct communicating with said case on a lower side thereof;

a supply duct for fresh air, said supply duct communicating with said case on an upper side thereof; and an exhaust duct for exhausting air, said exhaust duct communicating with said case on said upper side thereof.

* * * * *